US009689184B2

(12) United States Patent
Kang

(10) Patent No.: US 9,689,184 B2
(45) Date of Patent: Jun. 27, 2017

(54) DOOR OUTSIDE HANDLE FOR VEHICLE

(71) Applicant: Hyundai Motor Company, Seoul (KR)

(72) Inventor: Bo Ram Kang, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 257 days.

(21) Appl. No.: 14/483,038

(22) Filed: Sep. 10, 2014

(65) Prior Publication Data

US 2015/0167362 A1 Jun. 18, 2015

(30) Foreign Application Priority Data

Dec. 17, 2013 (KR) ..... 10-2013-0156972

(51) Int. Cl.
*E05B 3/00* (2006.01)
*E05B 85/16* (2014.01)
*E05B 77/06* (2014.01)

(52) U.S. Cl.
CPC ..... *E05B 85/16* (2013.01); *E05B 77/06* (2013.01); *Y10T 292/57* (2015.04)

(58) Field of Classification Search
CPC .... Y10T 292/57; Y10S 292/22; Y10S 292/65; E05B 77/02; E05B 77/04; E05B 77/06; E05B 85/10; E05B 85/14; E05B 85/16
See application file for complete search history.

(56) References Cited

U.S. PATENT DOCUMENTS 6,042,159 A * 3/2000 Spitzley ..... E05B 77/06 16/111.1
2014/0015262 A1* 1/2014 Da Deppo ..... E05B 77/06 292/336.3
2014/0015263 A1* 1/2014 Da Deppo ..... E05B 85/16 292/336.3

FOREIGN PATENT DOCUMENTS

EP 2708691 A2 * 3/2014 ..... E05B 77/06
JP 2006-207347 A 8/2006
JP 2013-014988 A 1/2013
KR 10-2009-0062866 A 6/2009
KR 10-2011-0019672 A 2/2011

* cited by examiner

*Primary Examiner* — Alyson M Merlino
(74) *Attorney, Agent, or Firm* — Morgan Lewis & Bockius LLP

(57) ABSTRACT

A door outside handle for a vehicle may include a handle lever configured to be mounted on a grip handle, a rotating lever configured to be rotatably connected with the handle lever via a lever shaft, and a rotating lever restriction part configured to be included in the handle lever and the rotating lever and release a restriction of the rotating lever to rotate the rotating lever when side crash accidents occur and restrict the rotation of the rotating lever when the side crash accidents do not occur.

9 Claims, 7 Drawing Sheets

DOOR OUTSIDE HANDLE FOR VEHICLE

CROSS REFERENCE TO RELATED APPLICATION

The present application claims priority of Korean Patent Application Number 10-2013-0156972 filed on Dec. 17, 2013, the entire contents of which application are incorporated herein for all purposes by this reference.

BACKGROUND OF INVENTION

Field of Invention

The present invention relates to a door outside handle for a vehicle, and more particularly, to a technology of a door outside handle for a vehicle capable of preventing an unwanted opening operation of a vehicle door by shorting a connection between a handle grip and a balance weight at the time of the occurrence of side crash accidents.

Description of Related Art

A door outside handle for a vehicle is a handle operated by a driver to open the door outside the vehicle. As illustrated in FIGS. 1 to 3, the door outside handle for a vehicle includes a handle base 10 mounted to be fixed to an inside of a door outer panel 1, a balance weight 20 configured to be elastically and rotatably connected with the handle base 10 via a balance shaft 21 and a balance spring 22, connected with a door latch via a cable 23, and have a balance lever 24 and a weight 25 disposed at both sides thereof based on the balance shaft 21, and a grip handle 30 configured to have one end and the other end provided with a handle hinge 31 which is rotatably connected with one end of the handle base 10 and a handle lever 32 which is mounted to contact the balance lever 24 of the balance weight 20.

In this configuration, an end of the handle lever 32 is integrally provided with a bending part 32*a* which is bent at a right angle, and therefore the handle lever 32 has a structure in which the bending part 32*a* is mounted to contact the balance lever 24.

Therefore, when a driver grips and pulls (arrow M1) the grip handle 30, the bending part 32*a* of the handle lever 32 transfers a force through the balance lever 24 to rotate the balance weight 20 (arrow R1). In this case, the cable 23 is pulled and the door latch is operated by a pulling action of the cable 23, such that the door of the vehicle may be opened.

However, the door outside handle according to the related art has a disadvantage in that the unwanted opening operation of the door is performed at the time of the occurrence of side crash accidents. That is, when crash energy is transferred to a door panel (arrow F1), the grip handle 30 rotates the door in the arrow M1 direction which is a direction of opening the door by an inertial force.

However, since the related art has a structure in which the end of the handle lever 32 is integrally provided with the bending part 32*a* contacting the balance lever 24, when the grip handle 30 rotates in the arrow M1 direction by the inertial force at the time of side crash accidents, the balance weight 20 rotates (arrow R1) and the door latch is operated while the cable 23 is pulled, such that the unwanted opening operation of the vehicle door is performed.

In addition, rotating the grip handle 30 in the arrow M1 direction by the inertial force at the time of side crash is prevented by a spring force of the balance spring 22 and a weight of a weight 25 configuring the balance weight 20, but when considering the fact that a crash force and a crash direction are diverse, the structure in which the bending part 32*a* contacting the balance lever 24 is integrally provided with the handle lever 32 may not prevent all the opening operations of the door under diverse side crash situations.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a door outside handle for a vehicle capable of preventing an unwanted opening operation of a door by shorting a connection state between a handle lever and a balance lever at the time of the occurrence of side crash accidents, thereby more effectively protecting safety of passengers.

According to various aspects of the present invention, there is provided a door outside handle for a vehicle, including: a handle lever configured to be mounted on a grip handle, a rotating lever configured to be rotatably connected with the handle lever via a lever shaft, and a rotating lever restriction part configured to be included in the handle lever and the rotating lever and release a restriction of the rotating lever to rotate the rotating lever when side crash accidents occur and restrict the rotation of the rotating lever when the side crash accidents do not occur.

When the rotation of the rotating lever is restricted by the rotating lever restriction part, the rotating lever may keep in a contact state with the balance lever of a balance weight. When the restriction of the rotating lever is released by the rotating lever restriction part, the rotating lever may keep in a balance state with the balance lever of a balance weight.

The rotating lever restricting part may include: an insertion groove configured to have a portion opened at the rotating lever; and a mass body configured to be included in the handle lever and restrict the rotation of the rotating lever by keeping a state inserted into the insertion groove when the side crash accidents do not occur and release the restriction of the rotating lever by separating from the insertion groove due to a movement by an inertial force when the side crash accidents occur.

The rotating lever restricting part may further include: a guide passage configured to be formed in the handle lever along a longitudinal direction and have an opened portion, and a mass body spring configured to have one end fixed to the guide passage and the other end fixedly mounted to the mass body and provide an elastic force to the mass body so that the mass body moves to the rotating lever.

The rotating lever restricting part may further include: a lever spring configured to have one end connected with the lever shaft and the other end connected with the rotating lever and rotate the handle lever by an accumulated elastic force so that the rotating lever extends in the longitudinal direction of the handle lever when the mass body separates from the insertion groove.

The mass body may be integrally provided with a mass body shaft which remains inserted into the insertion groove of the rotating lever or separates from the insertion groove.

The rotating lever may be rotatably connected with the handle lever substantially at a right angle with respect to the longitudinal direction of the handle lever based on the lever shaft, and the handle lever may be provided with a stopper protrusion which restricts a right angle rotation of the rotating lever by contacting the rotating lever.

When the rotating lever rotates substantially at a right angle with respect to the handle lever, an opening of the guide passage and an opening of the insertion groove may be disposed on a same line. When the rotating lever rotates to extend along the longitudinal direction of the handle lever, the opening of the guide passage and the opening of the insertion groove may cross each other substantially at a right angle.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
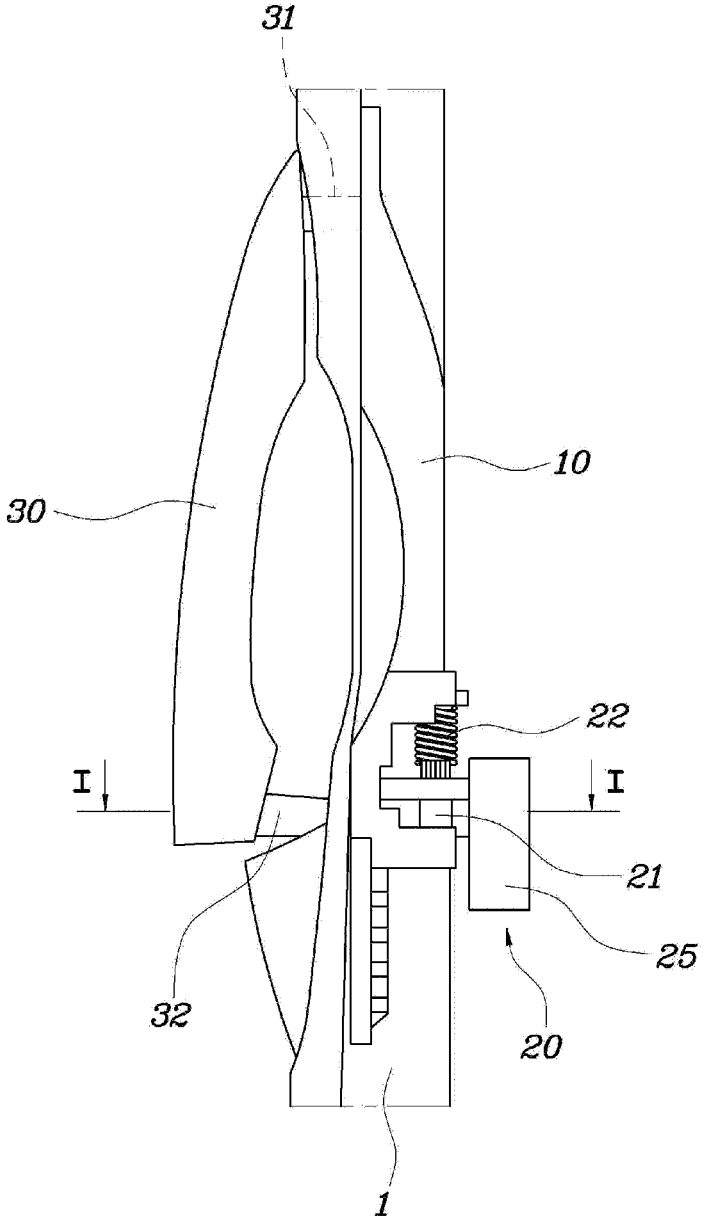
FIG. 1 (Prior Art)
FIG. 1 is a view for describing a door outside handle for a vehicle according to the related art.
Figure 2:
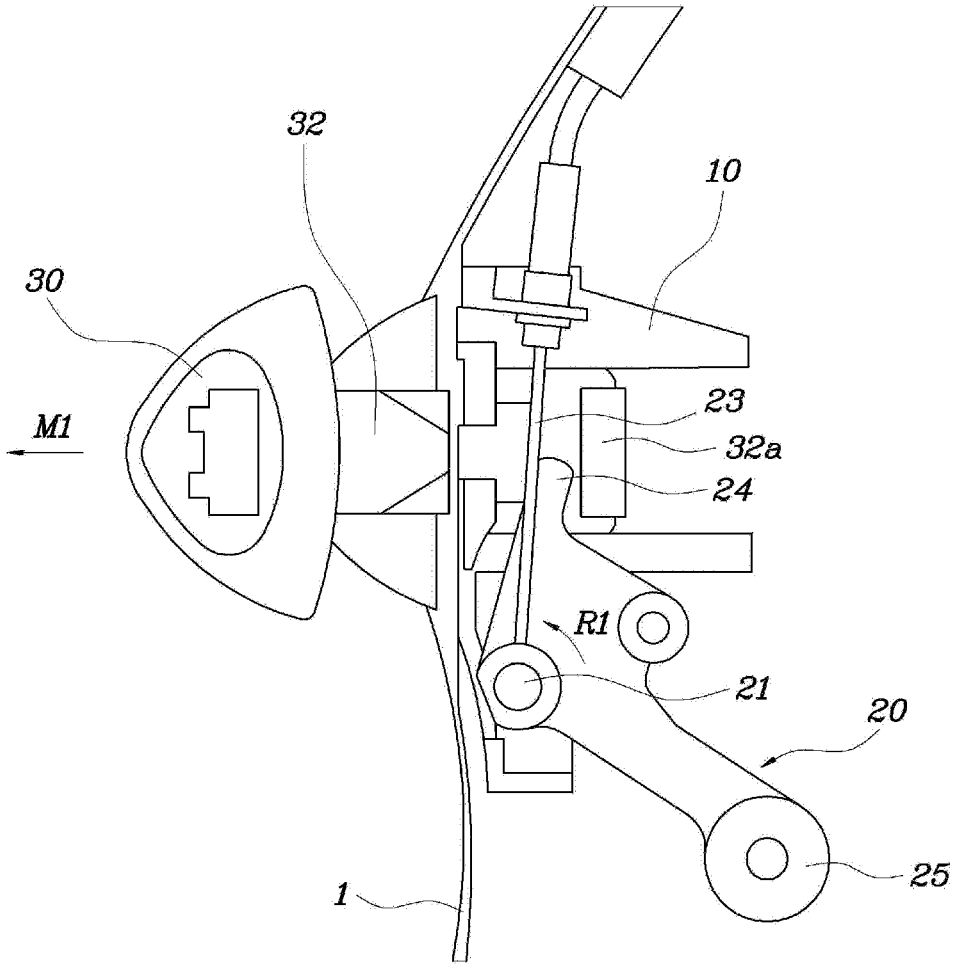
FIG. 2 (Prior Art)
FIG. 2 is a cross-sectional view taken along the line I-I of FIG. 1.
Figure 3:
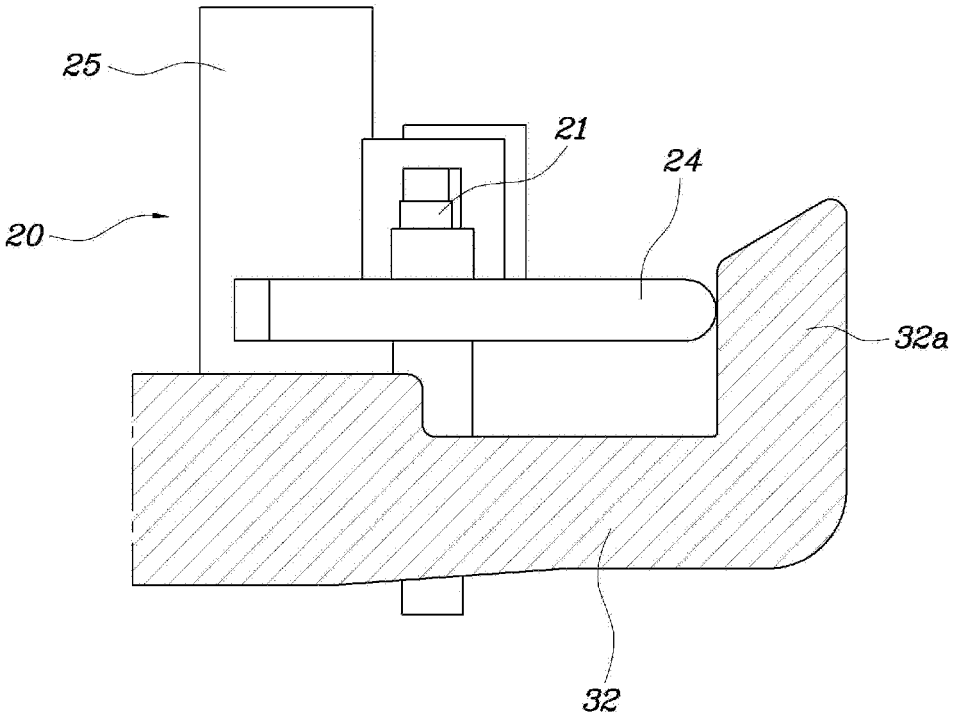
FIG. 3 (Prior Art)
FIG. 3 is a view for describing a bending part of a handle lever in FIG. 2.

Referring to FIGS. 1 and 2, the door outside handle for a vehicle according to various embodiments of the present invention includes: a handle base 10 fixedly mounted to an inside of a door outer panel 1; a balance weight 20 configured to be elastically and rotatably connected with the handle base 10 via a balance shaft 21 and a balance spring 22, connected with a door latch via a cable 23, and have a balance lever 24 and a weight 25 disposed at both sides thereof based on the balance shaft 21; and a grip handle 30 configured to be rotatably connected with one end of the handle base 10 and operated to rotate the balance weight 20 at the time of a rotation operation.

According to various embodiments of the present invention, one end of the grip handle 30 is provided with a handle hinge 31 which is rotatably connected with the handle base 10 and the other end of the grip handle 30 is provided with a handle lever 35 on which a mass body 50 to be described below is mounted.

That is, the door outside handle for a vehicle according to various embodiments of the present invention includes: a rotating lever 40 configured to be rotatably connected with the handle lever 35 via a lever shaft 41 as illustrated in FIGS. 4 to 7; and a rotating lever restriction part configured to be included in the handle lever 35 and the rotating lever 40 and release a restriction of the rotating lever 40 so as to rotate the rotating lever 40 when the side crash accidents occur and restrict the rotation of the rotating lever 40 when the side crash accidents do not occur.

Figure 4:
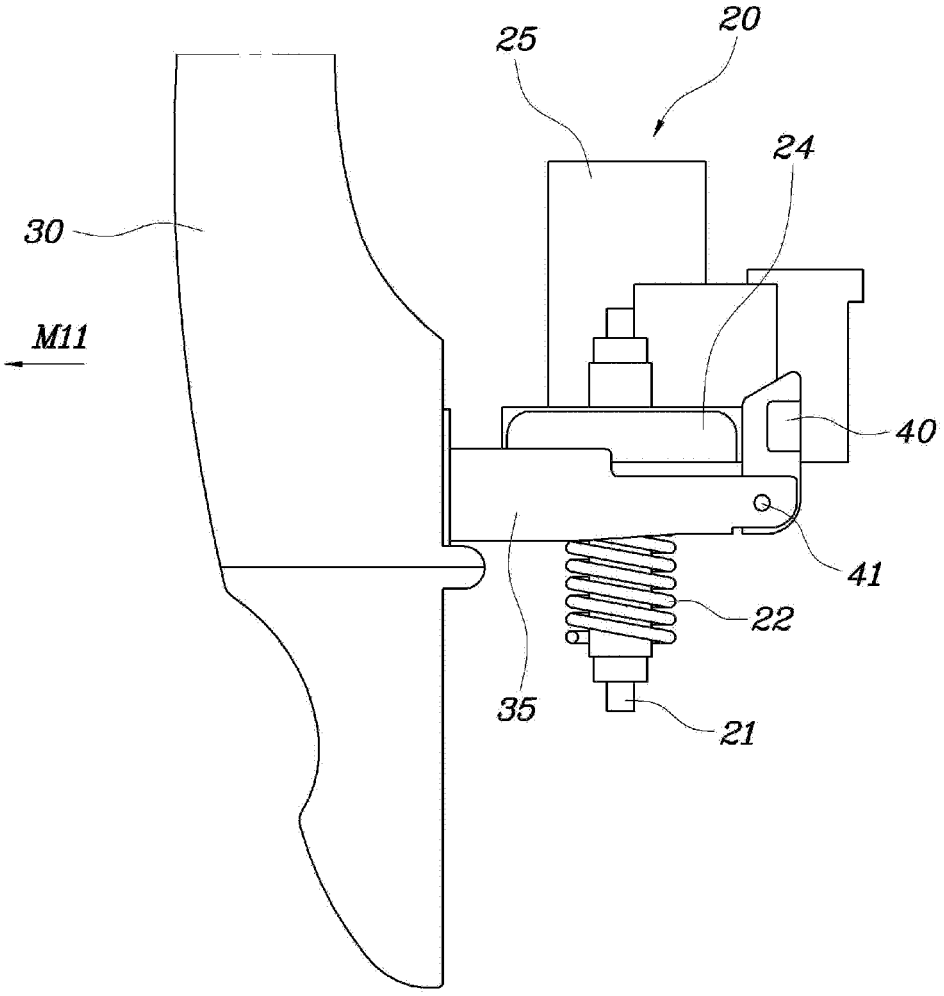
FIGS. 4 and 5 are views illustrating an exemplary door outside handle for a vehicle according to the present invention, in a case when side crash accidents do not occur.
Figure 5:
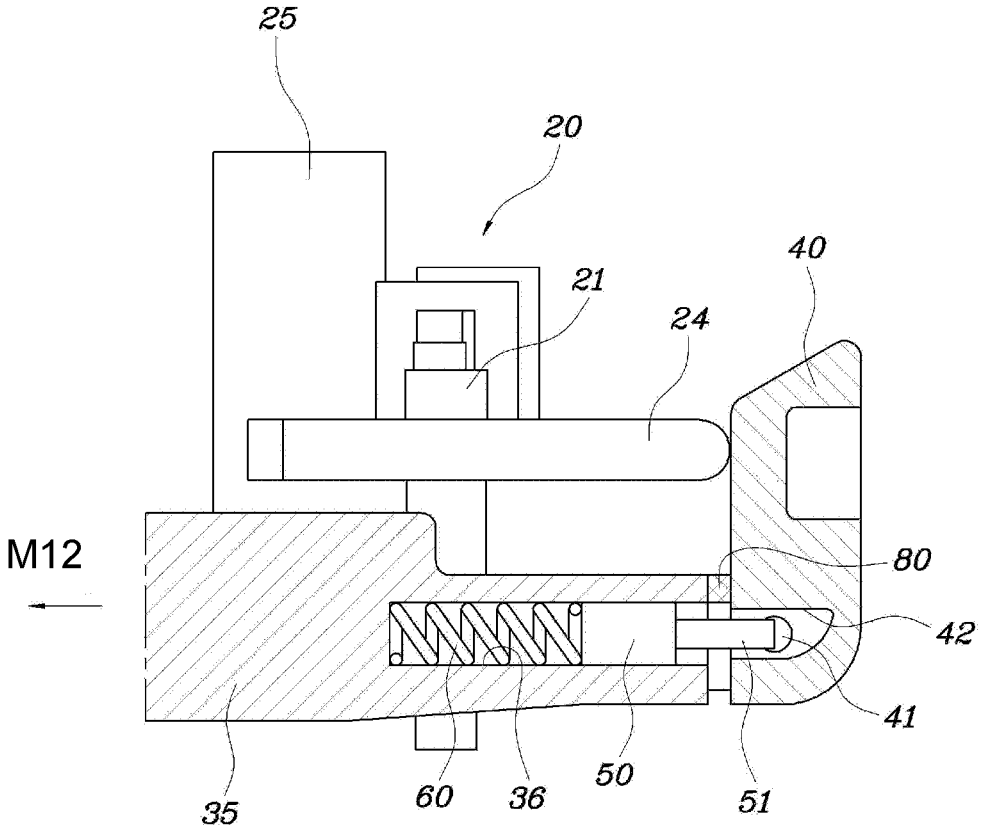
Figure 6:
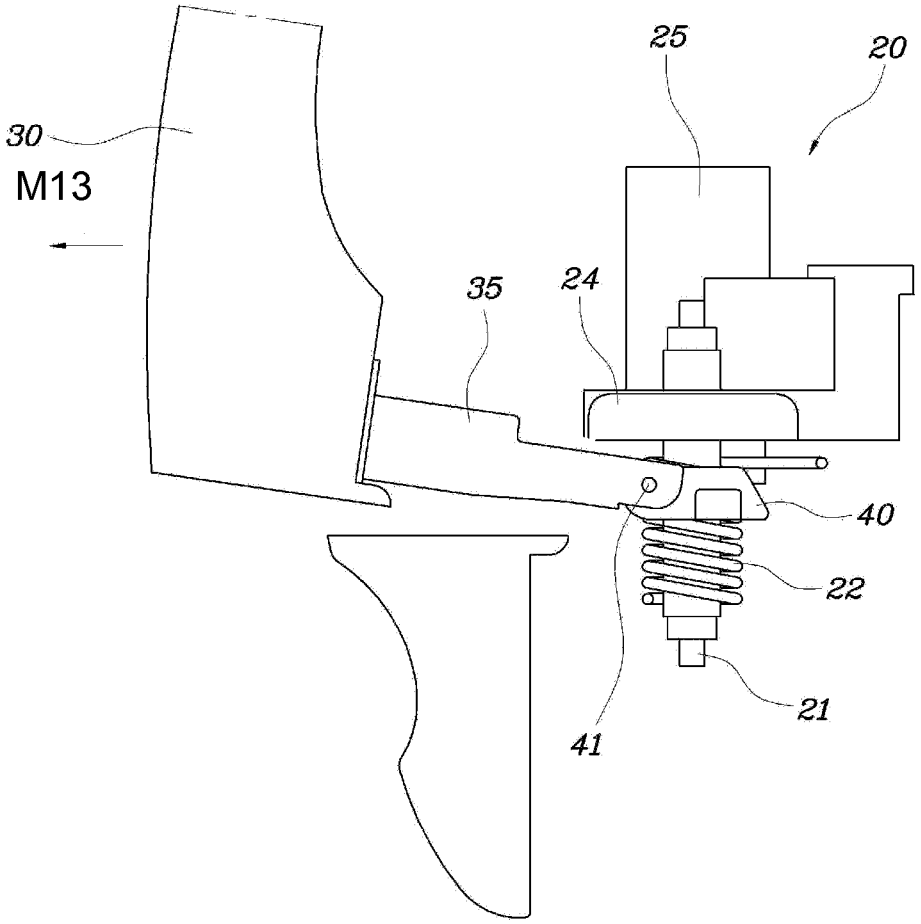
FIGS. 6 and 7 are views illustrating an exemplary door outside handle for a vehicle according to the present invention, and illustrating an operation state when side crash accidents occur.
Figure 7:
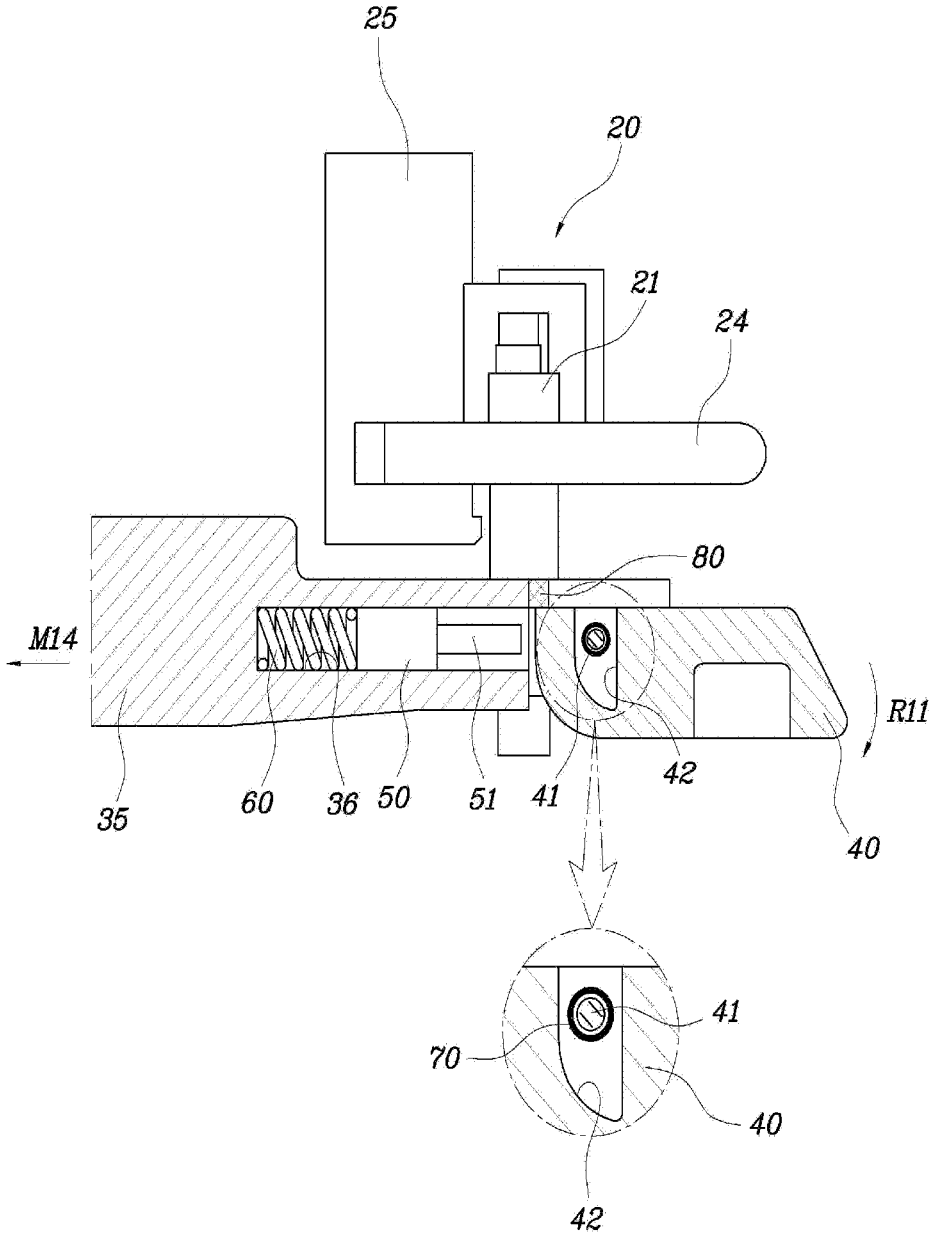

According to various embodiments of the present invention, when the rotation of the rotating lever 40 is restricted by the rotating lever restriction part, the rotating lever 40 keeps a contact state with the balance lever 24 of the balance weight 20 as illustrated in FIGS. 4 and 5 and when the restriction of the rotating lever 40 is released by the rotating lever restriction part, the rotating lever 40 keeps a balance state with the balance lever 24 of the balance weight 20 as illustrated in FIGS. 6 and 7.

The rotating lever restriction part includes: an insertion groove 42 configured to have one portion opened at the rotating lever 40; and the mass body 50 configured to be included in the handle lever 35 and restrict the rotation of the rotating lever 40 by keeping a state inserted into the insertion groove 42 when the side crash accidents do not occur and release the restriction of the rotating lever 40 by separating from the insertion groove 42 due to the movement by an inertial force when the side crash accidents occur.

In various embodiments, the rotating lever restriction part further includes: a guide passage 36 configured to be formed in the handle lever 35 along a longitudinal direction and have one portion opened; a mass body spring 60 configured to have one end fixed to the guide passage 36 and the other end fixedly mounted to the mass body 50 and provide an elastic force to the mass body 50 so that the mass body 50 moves to the rotating lever 40; and a lever spring 70 configured to have one end connected with the lever shaft 41 and the other end connected with the rotating lever 40 in a form in which the lever spring 70 is wound around the lever shaft 41 and rotate the handle lever 35 by an accumulated elastic force so that the rotating lever 40 extends in the longitudinal direction of the handle lever 35 when the mass body 50 separates from the insertion groove 42.

Further, the mass body 50 is integrally provided with a mass body shaft 51 which remains inserted into the insertion groove 42 of the rotating lever 40 or separates from the insertion groove 42. One will appreciate that such integral components may be monolithically formed.

Meanwhile, the rotating lever 40 is rotatably connected with the handle lever 35 at or substantially at a right angle with respect to the longitudinal direction of the handle lever 35 based on the lever shaft 41 and the handle lever 35 is provided with a stopper protrusion 80 which restricts a right angle rotation of the rotating lever 40 by contacting the rotating lever 40.

Further, when the rotating lever 40 rotates at or substantially at a right angle with respect to the handle lever 35 as illustrated in FIGS. 4 and 5, an opening of the guide passage 36 and an opening of the insertion groove 42 are disposed on the same line and when the rotating lever 40 rotates to extend along the longitudinal direction of the handle lever 35 as illustrated in FIGS. 6 and 7, the opening of the guide passage 36 and the opening of the insertion groove 42 cross each other at a right angle.

Hereinafter, an action of various embodiments of the present invention will be described.

First, FIGS. 4 and 5 illustrate a normal state in which the side crash accidents do not occur. In this case, the rotating lever 40 keeps a right angle (orthogonal direction) or keeps substantially a right angle with respect to the handle lever 35 and the rotating lever 40 keeps the contact state with the balance lever 24 of the balance weight 20.

Further, the mass body 50 moves to the rotating lever 40 by the elastic force of the mass body spring 60, such that the mass body shaft 51 remains inserted into the insertion groove 42 of the rotating lever 40.

Meanwhile, when the rotating lever 40 rotates with respect to the handle lever 35 at or substantially at a right angle, the lever spring 70 is in a compressed state to accumulate the elastic force and the rotating lever 40 applied with the accumulated elastic force rotates based on the lever shaft 41, but since the mass body shaft 51 is inserted into the insertion groove 42, the rotation of the rotating lever 40 is restricted by the mass body shaft 51, such that the rotating lever 40 continuously keeps the state rotating at or substantially at a right angle with respect to the handle lever 35.

In the above-mentioned normal state, when the driver grips and pulls the grip handle 30 (arrow M11), the handle lever 35 moves in the same direction together (arrow M12) and the rotating lever 40 contacting the balance lever 24 applies a force to the balance lever 24, such that the balance weight 20 rotates based on the balance shaft 21. In this case, the cable 23 is pulled and the door latch is operated by the pulling action of the cable 23, such that the door of the vehicle may be normally opened.

Further, FIGS. 6 and 7 illustrate the situation when the side crash accidents occur. In this case, when the crash energy generated at the time of the occurrence of side crash accidents is transferred to the grip handle 30, the grip handle 30 rotates in the same direction as the direction when the door is opened by the inertial force (arrow M13) and the handle lever 35 also moves in the same direction together (arrow M14).

However, when the side crash accidents occur, the mass body 50 also has a force moving in the same direction (arrow M14) as the moving direction of the handle lever 35 by the inertial force, such that the mass body 50 overcomes the force of the mass body spring 60 and moves along the guide passage 36.

Next, the mass body spring 60 is compressed and the mass body shaft 51 separates from the insertion groove 42 and at the same time, the rotating lever 40 rotates based on the lever shaft 41 by an elastic resilience force of the lever spring 70 (arrow R11), such that the rotating lever 40 and the balance lever 24 are in a parallel state with each other.

Therefore, at the time of the occurrence of side crash accidents, the grip handle 30 rotates in the same direction as the direction when the door is opened by the inertial force (arrow M13), and even though the handle lever 35 also moves in the same direction together (arrow M14), the rotating lever 40 is in a parallel state with the balance lever 24 and does not contact the balance lever 24, such that the balance weight 20 does not rotate and the cable 23 is not pulled, thereby preventing the unwanted opening operation of the vehicle door at the time of the occurrence of side crash accidents.

As set forth above, according to various embodiments of the present invention, the unwanted opening operation of the door of the vehicle may be prevented by shorting the connection between the handle lever 35 and the balance lever 24 even though the grip handle 30 rotates in the same direction as the direction of opening the door by the inertial force at the time of the occurrence of side crash accidents, thereby more effectively protecting the safety of passengers.

For convenience in explanation and accurate definition in the appended claims, the terms "inner" or "outer", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door outside handle for a vehicle, comprising:

a handle lever configured to be mounted on a grip handle;

a rotating lever configured to be rotatably connected with the handle lever via a lever shaft; and a rotating lever restriction part configured to be included in the handle lever and the rotating lever so as to release a restriction of the rotating lever, allowing the rotating lever to rotate when a side crash accident occurs, and to restrict a rotation of the rotating lever when a side crash accident does not occur, wherein the rotating lever restriction part includes:

an insertion groove configured to have a portion opened at the rotating lever; and a mass body configured to be included in the handle lever so as to restrict the rotation of the rotating lever by keeping a state in which a portion of the mass body is inserted into the insertion groove when a side crash accident does not occur, and to release the rotation of the rotating lever by separating the portion of the mass body from the insertion groove due to a movement by an inertial force when a side crash accident occurs, and wherein the rotating lever restriction part further includes:

a guide passage configured to be formed in the handle lever along a longitudinal direction and have an opened portion; and a mass body spring configured to have one end fixed to the guide passage and another end fixedly mounted to the mass body so as to provide an elastic force to the mass body so that the mass body moves toward the rotating lever.

2. The door outside handle for a vehicle of claim 1, wherein when the rotation of the rotating lever is restricted by the rotating lever restriction part, the rotating lever keeps in a contact state with a balance lever of a balance weight.

3. The door outside handle for a vehicle of claim 1, wherein when the restriction of the rotating lever is released by the rotating lever restriction part, the rotating lever keeps in a balance state with a balance lever of a balance weight.

4. The door outside handle for a vehicle of claim 1, wherein the rotating lever restriction part further includes:

a lever spring configured to have one end connected with the lever shaft and another end connected with the rotating lever so as to rotate the handle lever by an accumulated elastic force so that the rotating lever extends in a longitudinal direction of the handle lever when the portion of the mass body separates from the insertion groove.

5. The door outside handle for a vehicle of claim 1, wherein the portion of the mass body is a mass body shaft integrally provided on the mass body, and which is inserted into the insertion groove of the rotating lever or separates from the insertion groove.

6. The door outside handle for a vehicle of claim 1, wherein the rotating lever is rotatably connected with the handle lever substantially at a right angle with respect to a longitudinal direction of the handle lever by the lever shaft, and the handle lever is provided with a stopper protrusion which restricts a right angle rotation of the rotating lever by contacting the rotating lever.

7. The door outside handle for a vehicle of claim 6, wherein when the rotating lever is substantially at a right angle with respect to the handle lever, the opened portion of the guide passage and the opened portion of the insertion groove are disposed on the same line when a side crash accident does not occur.

8. The door outside handle for a vehicle of claim 6, wherein when the rotating lever is rotated by a lever spring when a side crash accident occurs, the rotating lever extends along the longitudinal direction of the handle lever such that the opened portion of the guide passage and the opened portion of the insertion groove cross each other substantially at a right angle.

9. A door outside handle for a vehicle, comprising:

a handle lever configured to be mounted on a grip handle;

a rotating lever configured to be rotatably connected with the handle lever via a lever shaft; and a rotating lever restriction part configured to be included in the handle lever and the rotating lever so as to release a restriction of the rotating lever, allowing the rotating lever to rotate when a side crash accident occurs, and to restrict the rotation of the rotating lever when a side crash accident does not occur, wherein the rotating lever restriction part includes:

an insertion groove configured to have a portion opened at the rotating lever; and a mass body configured to be included in the handle lever so as to restrict the rotation of the rotating lever by keeping a state in which a portion of the mass body is inserted into the insertion groove when a side crash accident does not occur, and to release the rotation of the rotating lever by separating the portion of the mass body from the insertion groove due to a movement by an inertial force when a side crash accident occurs, and wherein the rotating lever restriction part further includes:

a lever spring configured to have one end connected with the lever shaft and another end connected with the rotating lever so as to rotate the handle lever by an accumulated elastic force so that the rotating lever extends in a longitudinal direction of the handle lever when the portion of the mass body separates from the insertion groove.

* * * * *